US007654971B2

(12) United States Patent
Yu

(10) Patent No.: US 7,654,971 B2
(45) Date of Patent: Feb. 2, 2010

(54) DEVICE FOR MASSAGING FEET AND CALVES

(76) Inventor: Chun-Chien Yu, 608, Shoei Yuan Rd., Feng-Yuan, Taichung (TW) 42080

( * ) Notice: Subject to any disclaimer, the term of this patent is extended or adjusted under 35 U.S.C. 154(b) by 653 days.

(21) Appl. No.: 11/396,468

(22) Filed: Apr. 4, 2006

(65) Prior Publication Data

US 2007/0232969 A1 Oct. 4, 2007

(51) Int. Cl.
*A61H 7/00* (2006.01)
*A61H 19/00* (2006.01)

(52) U.S. Cl. ..... 601/99; 601/101; 601/103; 601/104

(58) Field of Classification Search ..... 601/19, 601/22, 23, 24, 26, 27, 28, 29, 31, 32, 33, 601/52, 63, 87, 97, 98, 99, 101, 102, 103, 601/104, 115, 116, 122, 126, 128, 131, 144
See application file for complete search history.

(56) References Cited

U.S. PATENT DOCUMENTS 3,083,709 A * 4/1963 Lengsfeld ..... 601/126
4,003,374 A * 1/1977 Mizrachy ..... 601/89
4,637,379 A * 1/1987 Saringer ..... 601/34
5,211,161 A * 5/1993 Stef ..... 601/5
5,772,614 A * 6/1998 Lindquist ..... 601/116
6,740,016 B1 * 5/2004 Lee ..... 482/146
6,837,831 B2 * 1/2005 Lee ..... 482/60
7,150,720 B2 * 12/2006 Adkins et al. ..... 601/22
7,217,248 B2 * 5/2007 Lin ..... 601/115
2003/0225348 A1 * 12/2003 Chen ..... 601/28
2004/0030274 A1 * 2/2004 Wu ..... 601/115

FOREIGN PATENT DOCUMENTS

GB 2434318 A * 7/2007

* cited by examiner

*Primary Examiner*—Justine R Yu
*Assistant Examiner*—Clinton Ostrup
(74) *Attorney, Agent, or Firm*—Bacon & Thomas, PLLC

(57) ABSTRACT

A massage device includes a frame including a top board, a support plate, and a forward support; a drive unit including a rod interconnected a motor driven flywheel and a transverse bar in the support, and a pivotal arm having a lower end pivotably connected to the bar; a feet massage unit including a forward brace plate releasably secured to an upper portion of the arm; and a calf massage unit mounted on the board. Resting the calves on rollers of the calf massage unit, contacting bottoms of the feet with rollers of the feet massage unit, resting the ankles on the support plate, and powering on the drive unit will rotate the rollers to massage the calves and the bottoms of the feet and relieve pain on nerve centers in the parts of the legs below the knees with the foot massage unit reciprocated.

2 Claims, 7 Drawing Sheets

Fig・1
PRIOR ART

DEVICE FOR MASSAGING FEET AND CALVES

BACKGROUND OF THE INVENTION

1. Field of Invention

The present invention relates to massage equipment and more particularly to a device capable of massaging feet and calves and relieving pain on nerve centers in the parts of the legs below the knees.

2. Related Art

A wide variety of massage devices are commercially available. For example, a conventional foot massage device is shown in FIG. 1. As illustrated, five rows of rollers are mounted between a left frame element and a central frame element and five rows of rollers are mounted between a right frame element and the central frame element respectively. In use, a person stands on the massage device and walks thereon. As such, the rollers roll to massage bottoms of the feet.

But this is unsatisfactory for the purpose for which the invention is concerned for the following reasons: The massage device is designed to massage foot bottom only. Further, the standing is not stable. Thus, the person may fall from the device if sufficient care is not taken during the massage. Furthermore, the massage device is unable to relieve pain on nerve centers in the parts of the legs below the knees. Thus, the need for improvement still exists.

SUMMARY OF THE INVENTION

It is therefore an object of the present invention to provide a massage device comprising a frame including a top board mounted on legs, two side posts proximate a front end, each post having a plurality of upper first holes disposed vertically, and a support extended forward from the front end; a drive unit provided below the board and including a motor, a flywheel mounted on one end of a rotating shaft of the motor, a connecting rod having one end connected to the flywheel, a transverse bar mounted in the support and having one end pivotably connected to the other end of the connecting rod, and an arm having a lower end pivotably connected to the other end of the connecting rod and a pivot portion above its lower end pivotably connected to an upper portion of the support; a feet massage unit including a first frame element, a brace plate extended forward from the first frame element, the brace plate including a plurality of sets of second holes wherein an upper portion of the arm is mounted at the sets of second holes, and two parallel sets of first rollers, each set of the first rollers being electrically connected to the motor and mounted across both sides of either half of the first frame element; a calf massage unit mounted on the board and including a second frame element, and a plurality of transverse second rollers electrically connected to the motor and mounted across both sides of the second frame element; and a transverse plate member including two underside side cylinders, and a pin adapted to insert into the cylinders and through the first hole for releasably fastening; whereby resting the calves of a person on the second rollers, contacting bottoms of the feet with the first rollers, resting the ankles on the plate member, and powering on the drive unit will rotate the first and second rollers to massage the calves and the bottoms of the feet and relieve pain on nerve centers in the parts of the legs below the knees with the foot massage unit reciprocated.

In one aspect of the present invention the calves are adapted to rest on two top ones of the first rollers such that powering on the drive unit will rotate the top ones of the first rollers to massage the calves and relieve pain on nerve centers in the calves with the foot massage unit reciprocated.

The above and other objects, features and advantages of the present invention will become apparent from the following detailed description taken with the accompanying drawings.

DETAILED DESCRIPTION OF THE INVENTION

Figure 1:
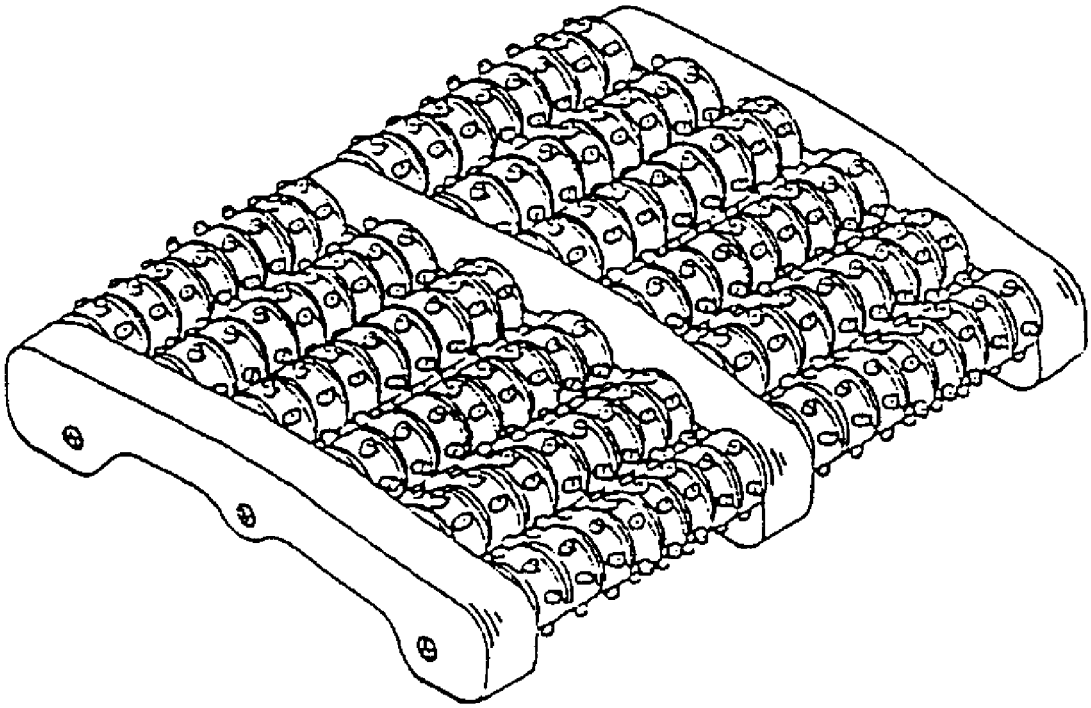
FIG. 1 is a perspective view of a conventional foot massage device.
Figure 2:
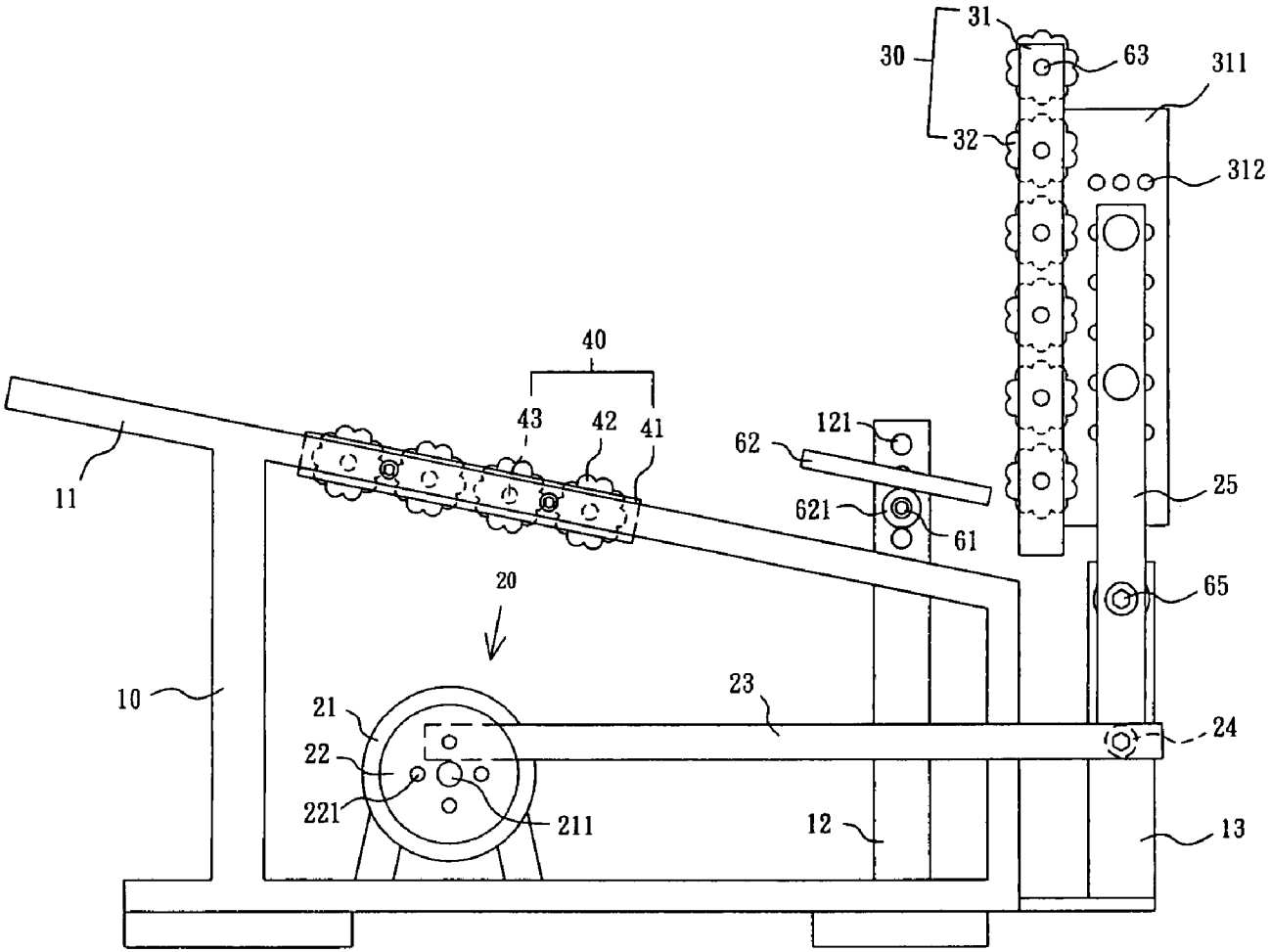
FIG. 2 is a side elevation view of a preferred embodiment of massage device according to the invention.
Figure 3:
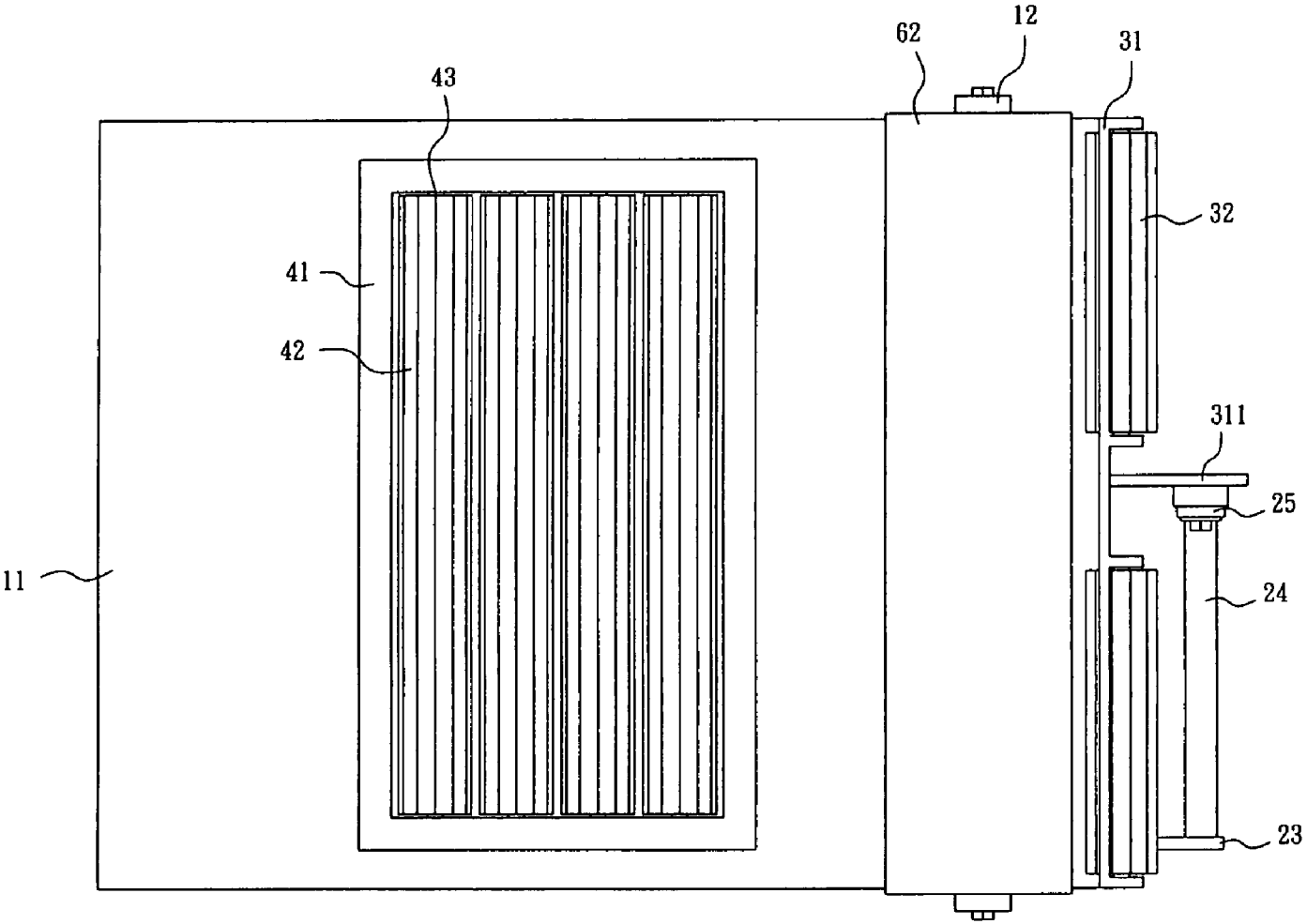
FIG. 3 is a top plan view of the device in FIG. 2.
Figure 4:
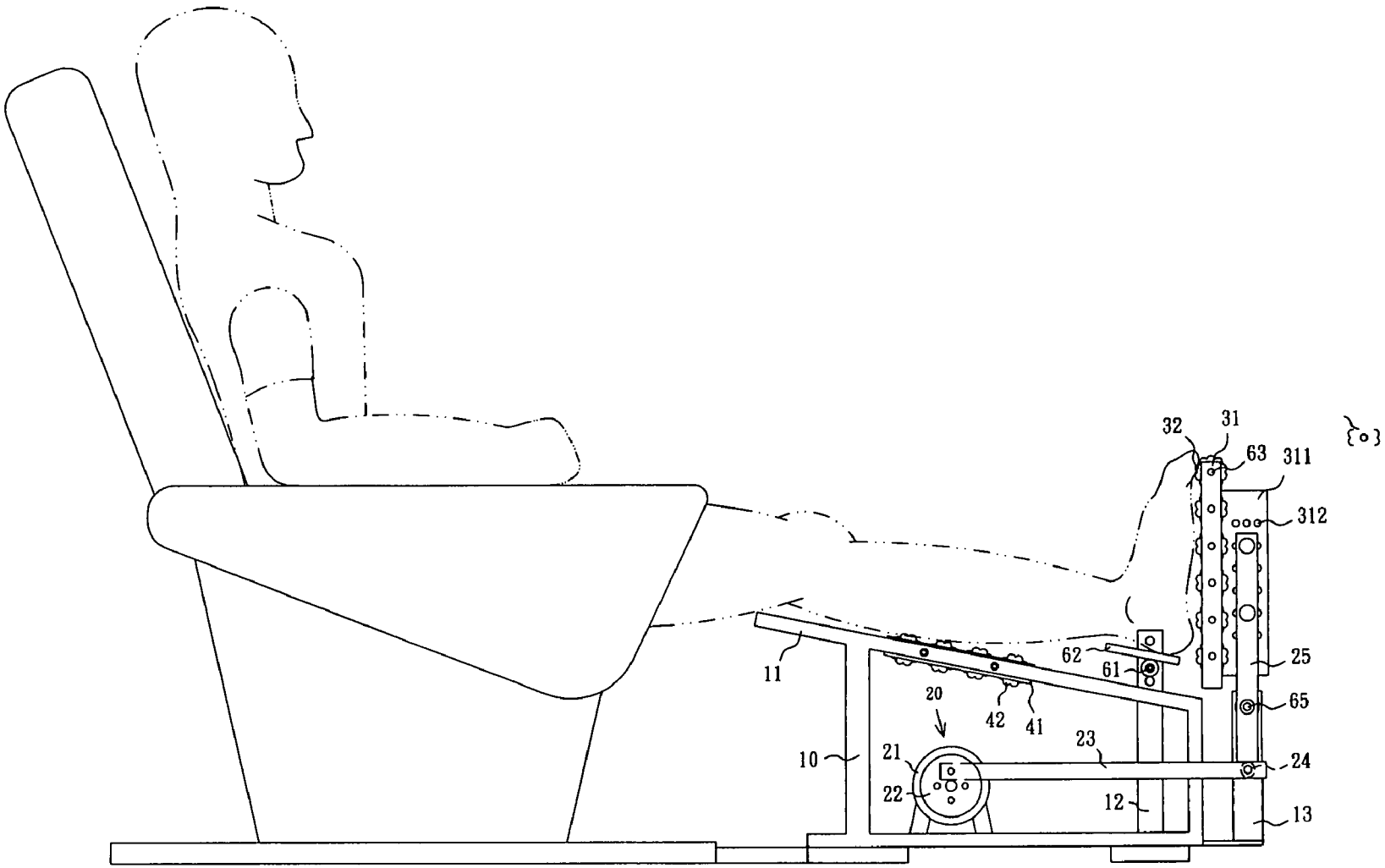
FIG. 4 is an environmental side view of the massage device in FIG. 2 being operated to massage feet and calves of a person sitting on a chair.
Figure 5:
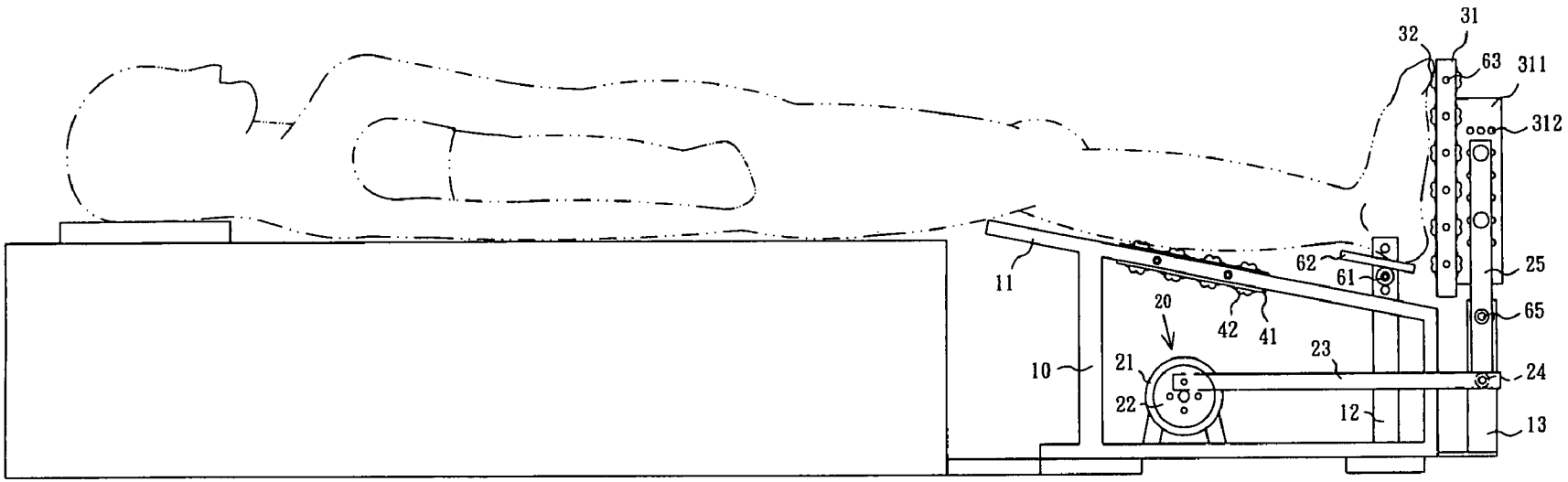
FIG. 5 is another environmental side view of the massage device in FIG. 2 being operated to massage feet and calves of a person lying on a sofa.
Figure 6:
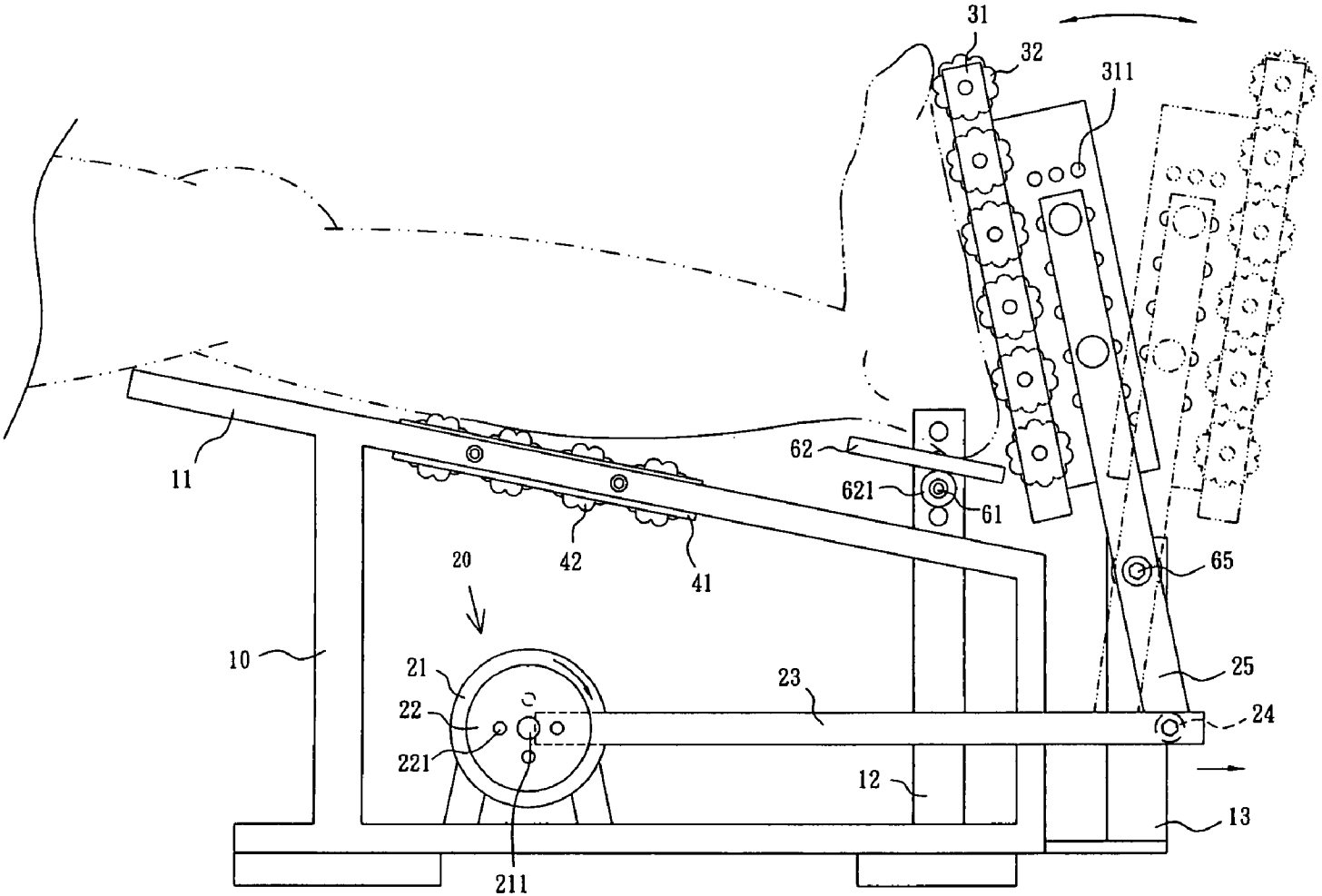
FIG. 6 is an enlarged view of FIG. 5.

Referring to FIGS. 2 to 7, a massage device in accordance with a preferred embodiment of the invention comprises a frame 10, a drive unit 20, a feet massage unit 30, and a calf massage unit 40. Each component is discussed in detailed below.

The frame 10 comprises a top board 11 disposed above a supporting ground by a predetermined distance, two side posts 12 proximate its front end, each post 12 having a plurality of upper holes 121 disposed vertically, and a support 13 extended forward from the front end.

The drive unit 20 is provided on a bottom of the frame 10 below the board 11. The drive unit 20 comprises a motor 21, a flywheel 22 mounted on one end of a rotating shaft 211 of the motor 21 and including four lateral holes 221 provided peripherally relative to the rotating shaft 211, a connecting rod 23 having one end connected to one of the holes 221, a transverse bar 24 mounted in the support 13 and having one end pivotably connected to the other end of the connecting rod 23, and an arm 25 having a lower end pivotably connected to the other end of the connecting rod 23 (i.e., also at one end of the bar 24).

The feet massage unit 30 comprises a rectangular frame element 31 including a rectangular brace plate 311 extended forward, the brace plate 311 including a plurality of holes 312 arranged in matrix in which height of the feet massage unit 30 can be adjusted by mounting an upper portion of the arm 25 at the holes 312 of different rows. The feet massage unit 30 further comprises two parallel sets of rollers each set including six rollers 32 mounted vertically in a non-operating position.

The calf massage unit 40 is mounted on the board 11 and comprises a rectangular frame element 41, and four parallel transverse rollers 42 each mounted across both sides of the frame element 41 by an axis 43. Note that both the rollers 32 and 42 are electrically connected to the motor 21.

The massage device further comprises a transverse plate 62 including two underside side cylinders 621, and a pin 61 adapted to insert into the cylinders 621 and through the hole 121 for fastening the plate 62 at the posts 12. Height of the plate 62 can be adjusted by inserting the pin 61 into a different one of the holes 121.

The massage device further comprises a pivot pin 65 pivotably connected the arm 25 to an upper portion of the support 13 above the connecting rod 23. The massage device further comprises a plurality of axes 63 each mounted across both sides of the roller 32 at either half portion of the frame element 31.

Figure 7:
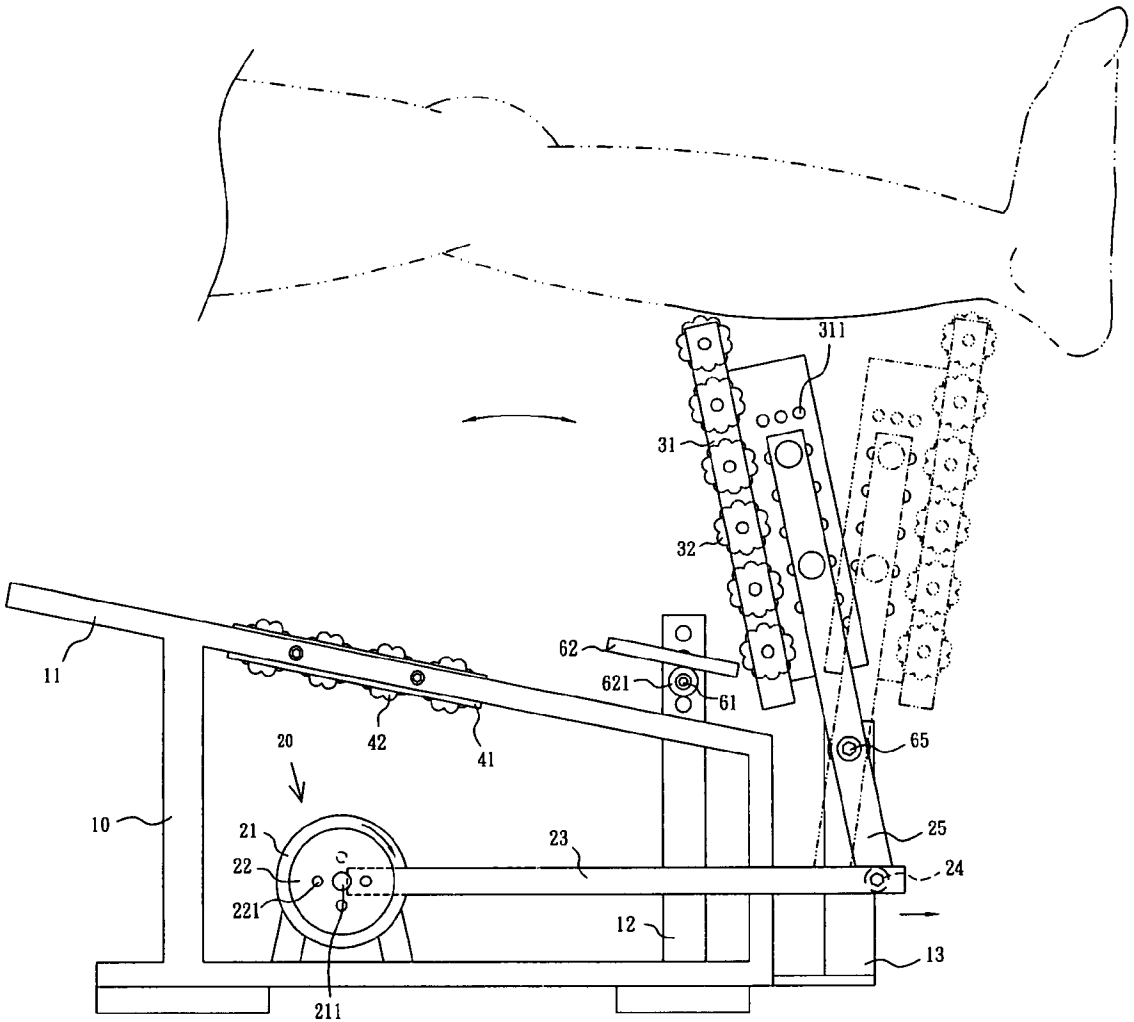
FIG. 7 is a view similar to FIG. 6 showing another configuration of the massage device in FIG. 2 where only the calves are being massaged.

A massaging operation of the invention will be described in detailed below. A person may sit on a chair (see FIG. 4) or lie on a sofa (see FIG. 5) with the calves rested on the rollers 42 of the calf massage unit 40, bottom of the feet contacted the rollers 32 of the foot massage unit 30, and the ankles rested on the plate 62. In response to powering on the drive unit 20 the rollers 32 and 42 rotate to massage the calves and bottoms of the feet. Also, the foot massage unit 30 reciprocates (see FIG. 6). As a result, not only the calves and the bottoms of the feet are massaged but also pain on nerve centers in the parts of the legs below the knees is relieved. As shown in FIG. 7, alternatively a person may rest the calves on the top rollers 32 such that powering on the drive unit 20 will rotate the top rollers 32 to massage the calves and relieve pain on nerve centers in the calves in a reciprocating manner.

While the invention herein disclosed has been described by means of specific embodiments, numerous modifications and variations could be made thereto by those skilled in the art without departing from the scope and spirit of the invention set forth in the claims.

What is claimed is:

1. A massage device comprising: a frame including a top board mounted on legs, two side posts proximate a front end, each post having a plurality of upper first holes disposed vertically, and a support extended forward from the front end; a drive unit provided below the board and including a motor, a flywheel mounted on one end of a rotating shaft of the motor, a connecting rod having one end connected to the flywheel, a transverse bar mounted in the support and having one end pivotably connected to the other end of the connecting rod, and an arm having a lower end pivotably connected to the other end of the connecting rod and a pivot portion above its lower end pivotably connected to an upper portion of the support; a feet massage unit including a first frame element, a brace plate extended forward from the first frame element, the brace plate including a plurality of sets of second holes wherein an upper portion of the arm is mounted at the sets of second holes, and two parallel sets of first rollers, each set of the first rollers coupled to the motor and mounted across both sides of either half of the first frame element; a calf massage unit mounted on the board and including a second frame element, and a plurality of transverse second rollers each mounted across both sides of the second frame element; and a transverse plate member including two underside side cylinders, and a pin adapted to insert into the cylinders and through the first hole for releasably fastening; whereby resting the calves of a person on the second rollers, contacting bottoms of the feet with the first rollers, resting the ankles on the plate member, and powering on the drive unit will rotate the first and second rollers to massage the calves and the bottoms of the feet and relieve pain on nerve centers in the parts of the legs below the knees with the foot massage unit reciprocated.

2. The massage device of claim 1, wherein the calves are adapted to rest on two top ones of the first rollers such that powering on the drive unit will rotate the top ones of the first rollers to massage the calves and relieve pain on nerve centers in the calves with the foot massage unit reciprocated.

* * * * *

UNITED STATES PATENT AND TRADEMARK OFFICE

CERTIFICATE OF CORRECTION

PATENT NO. : 7,654,971 B2
APPLICATION NO. : 11/396468
DATED : February 2, 2010
INVENTOR(S) : Chun-Chien Yu It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 957 days.

Signed and Sealed this

Twenty-eighth Day of December, 2010

David J. Kappos

David J. Kappos
*Director of the United States Patent and Trademark Office*